United States Patent [19]

Canter et al.

[11] Patent Number: 4,531,078

[45] Date of Patent: Jul. 23, 1985

[54] CONTROL CIRCUIT FOR ELECTRONIC FLASH

[75] Inventors: Joseph M. Canter, Lexington; William A. Shelton, Cambridge, both of Mass.

[73] Assignee: Polaroid Corporation, Cambridge, Mass.

[21] Appl. No.: 545,872

[22] Filed: Oct. 27, 1983

[51] Int. Cl.[3] ..... H05B 41/32

[52] U.S. Cl. ..... 315/151; 315/156; 315/157; 250/214 B; 354/414; 354/417

[58] Field of Search ..... 315/151, 156, 157, 241 P; 354/417, 414, 416; 250/214 B, 214 P, 214 AL

[56] References Cited

U.S. PATENT DOCUMENTS

| | | | |
|---|---|---|---|
| 3,591,829 | 7/1971 | Murata et al. | 315/151 |
| 3,709,123 | 1/1973 | Tokutomi | 354/417 X |
| 4,255,046 | 3/1981 | Corona | 315/151 X |
| 4,266,163 | 5/1981 | Lloyd | 315/151 |
| 4,317,620 | 3/1982 | Coppa et al. | 315/151 X |

OTHER PUBLICATIONS

Anonymous, "Electronic Strobe Flash Apparatus for Automatic Fill-in and Full Flash", *Research Disclosure*, Nov. 1980, No. 199, Item No. 19912.

*Primary Examiner*—David K. Moore
*Assistant Examiner*—Vincent DeLuca
*Attorney, Agent, or Firm*—Edward S. Roman

[57] ABSTRACT

A control circuit for timing the duration of a flash of artificial illumination from an electronic flash maintains a substantially uniform amount of artificial illumination regardless of the ambient scene light intensity by detecting the ambient scene light intensity up to the instant that the flash is fired and thereafter subtracting the ambient scene light intensity so detected immediately prior to the flash being fired from the ambient and artificial scene light intensity detected during the flash of artificial illumination.

9 Claims, 1 Drawing Figure

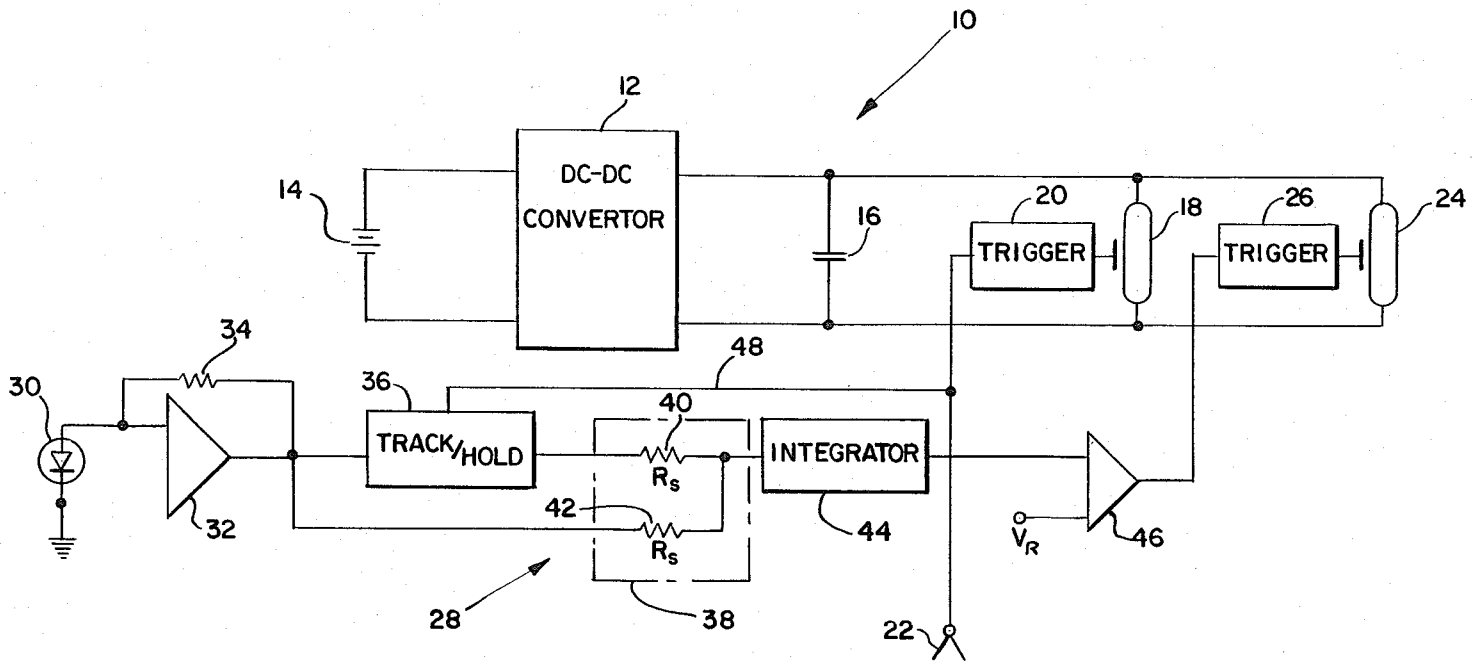
10
12
DC-DC
CONVERTOR
14
16
18
TRIGGER
20
24
TRIGGER
26
22
46
$V_R$
INTEGRATOR
44
48
40
$R_s$
$R_s$
38
42
28
TRACK/HOLD
36
34
32
30

CONTROL CIRCUIT FOR ELECTRONIC FLASH

BACKGROUND OF THE INVENTION

1. Field of the Invention

This invention relates generally to an electronic flash control circuit and, more particularly, to a control circuit for timing the duration of a flash of artificial illumination provided by an electronic flash.

2. Description of the Prior Art

Electronic flash devices of the type in which the duration of the flash of artificial illumination is automatically controlled are well known in the art. One such electronic flash device of this type is commonly known as a quench strobe and embodies a quench tube which when triggered into conduction rapidly discharges the remaining charge of a primary storage capacitor which charge would have otherwise been discharged through the light emitting flashtube. In this manner, the flash of artificial illumination may be rapidly quenched or terminated as is well known in the art. Other electronic flash devices in which the duration of the flash of artificial illumination may be controlled embody semiconductor switching devices such as thyristors in serial connection with respect to the light emitting flashtube. The thyristors may be switched into a nonconductive state to terminate the discharge of current through the flashtube thereby terminating the flash of artificial illumination. Regardless of how the flash of artificial illumination is actually terminated the aforementioned electronic flash devices derive a flash terminating control signal by first detecting the artificial and ambient scene light to provide an output signal corresponding to the intensity of the ambient and artificial scene light so detected. The output signal is thereafter integrated to a selected value to provide the flash termination control signal. In this manner a uniform amount of artificial scene light may be provided which corresponds to the selected value to which the output signal for the detected scene light is integrated to.

Under conditions of low or insignificant ambient scene light intensity where an electronic flash may be expected to be most commonly utilized to provide the major portion of the film exposing illumination, the aforementioned system operates quite satisfactorily since the ambient scene light intensity detected is only a negligible portion of the overall detected scene light. However, under conditions where the electronic flash is utilized to provide a fill-in flash of artificial illumination under conditions of relatively high ambient scene light intensity to brighten shadows, ambient scene light intensity is no longer a negligible proportion of the overall detected scene light and thus affects the timing of the flash of artificial illumination. As is readily apparent, the higher the ambient scene light intensity during the operation of the flash device, the less artificial scene light will be required to be detected for the integration circuit to reach its selected value and hence the electronic flash device can no longer be relied upon to provide a uniform amount of artificial scene illumination.

Therefore, it is a primary object of this invention to provide a control circuit for timing the duration of a flash of artificial illumination from an electronic flash in a manner ensuring that the electronic flash device provides a substantially uniform amount of illumination regardless of whether the flash is utilized in its ordinary manner to provide substantially all of the illumination required to properly expose the film or in its fill-in flash mode of operation wherein the electronic flash provides only a small proportion of the overall illumination required to expose the film.

It is a further object of this invention to provide a control circuit for timing the duration of a flash of artificial illumination from an electronic flash in a manner whereby the amount of artificial illumination may be maintained substantially uniform regardless of the intensity of the ambient scene light.

Other objects of the invention will be in part obvious and will in part appear hereinafter. The invention accordingly comprises a mechanism and system possessing a construction, combination of elements and arrangement of parts which are exemplified in the following detailed disclosure.

SUMMARY OF THE INVENTION

A control circuit for timing the duration of a flash of artificial illumination from an electronic flash comprises means for detecting the intensity of both the ambient and artificial scene light and for providing an output signal corresponding to the intensity of the ambient and artificial scene light so detected. Means respond to receipt of a signal corresponding to an applied flash fire signal for converting the output signal from the scene light detecting means to an artificial scene light detection signal indicative of only the artificial scene light intensity of the flash regardless of the ambient scene light intensity immediately prior to a flash being fired. The artificial scene light detection signal is thereafter integrated to provide an output flash termination control signal. The converting and integrating means operates to provide the artificial scene light detection signal by summing a first output signal from the detecting means corresponding to the ambient and artificial scene light intensity detected during the flash of artificial illumination and to a second output signal corresponding to the inverted value of the output signal from the detecting means for the ambient scene light intensity detected immediately prior to the flash of artificial illumination. The converting and integrating means also comprises an inverting tracking and holding means for providing an output signal corresponding to the inverted value of the output signal from the photoresponsive means. The inverting tracking and holding means also responds to the application of a signal corresponding to the flash fire signal by holding its output signal value constant so as to provide the second signal for the duration of the flash of artificial illumination while the detecting means provides the first signal. Summing means also operate to provide the artificial scene light detection signal in response to the summation of the first and second signals.

DESCRIPTION OF THE DRAWING

The novel features that are considered characteristic of the invention are set forth with particularity in the appended claims. The invention itself, however, both as to its organization and its method of operation, together with other objects and advantages thereof will be best understood from the following description of the illustrated embodiment when read in connection with the accompanying drawings wherein:

The drawing is a schematic diagram of an electronic flash device embodying the flash duration control circuit of this invention.

DESCRIPTION OF THE PREFERRED EMBODIMENT

Referring now to FIG. 1 there is shown at 10 a schematic diagram for an electronic flash device embodying the flash timing control circuit of this invention. The electronic flash device 10 comprises a conventional voltage converter 12 which operates in a well-known manner to convert a low DC voltage as may be derived from a 6-volt battery such as shown at 14 to a suitable flash operating voltage which may be in the order of 300 to 500 volts. The voltage converter 12 operates to charge a primary storage capacitor 16 which is subsequently discharged through a flashtube 18 in a well-known manner to produce a flash of artificial illumination. The flashtube 18 is ignited by a conventional trigger circuit 20 which can be set in operation upon the application of a flash fire pulse to an input terminal 22 of the electronic flash. The flash fire signal may be generated in any conventional manner such as by the closing of the synchronous contacts of a camera (not shown) operating in concert with the shutter blades as is well known in the art.

The electronic flash device 10 is of the type in which the duration of the flash of artificial illumination is controlled by the provision of a quench tube 24 which may be ignited by a trigger circuit 26 in a well-known manner to rapidly discharge or dump the remaining charge in the primary storage capacitor 16 thereby rapidly terminating the flash of artificial illumination. The trigger circuit 26 may be also of any conventional configuration which operates in response to the receipt of a flash termination control signal provided in the manner of this invention by a flash duration control circuit as shown generally at 28.

The flash duration control circuit 28 comprises a photoresponsive element 30 situated to detect the intensity of both the ambient and artificial scene light so as to provide an output signal corresponding to the intensity of the ambient and artificial scene light so detected. The output signal from the photoresponsive element 30 is thereafter amplified by a preamplifier 32 having a feedback resistor 34. The output signal from the preamplifier 32, in turn, is directed to an inverting track and hold circuit 36 which operates to provide an output signal corresponding to the inverted value of the output signal from the preamplifier 32. The inverting track and hold circuit 36 also responds to the application by way of line 48 of a signal corresponding to the flash fire signal applied to input terminal 22, by holding its output signal value constant for the duration of the flash of artificial illumination. The output signal from the inverting track and hold circuit 36, in turn, is directed in conjunction with the output signal from the preamplifier 32 to a summing circuit 38 comprising a pair of summing resistors 40 and 42. The summing circuit 38, in turn, provides an output artificial scene light detection signal which is thereafter directed to an integrator circuit 44, the output of which is thereafter directed to one input terminal of a comparator 46 of which the other input terminal is set at a reference voltage value $V_R$.

The electronic flash device 10 is operated in a well-known manner by first turning on the DC-to-DC converter 12 so as to charge the primary storage capacitor 16 and thereby ready the electronic flash for operation. The photoresponsive element 30 and preamplifier 32 are also enabled to operate in concert with the DC-to-DC converter 12 so that the photoresponsive element 30 detects the ambient scene light intensity and provides an output signal value corresponding to the ambient scene light intensity so detected. This output signal is subsequently amplified by the preamplifier 32 and directed to the inverting track and hold circuit 36 which operates to provide an output signal corresponding to the inverted value of the output signal from the preamp 32. The output signal from the inverting track and hold circuit 36, in turn, is directed to one input terminal of the summing circuit 38, the other input terminal of which receives the output signal directly from the preamp 32 such that the summation of the two signals operates to provide a zero output signal value to the integrator 44. Since the integrator 44 receives a zero input signal value prior to the flash of artificial illumination, there can be provided no increase in the output signal level therefrom to the comparator 44 so as to trigger the quench tube 24 prematurely prior to the flashtube 18 being triggered into conduction.

Application of a flash fire signal in the aforementioned manner to the input terminal 22 operates to set the trigger circuit 20 into operation to trigger the flashtube 18 into conduction so as to discharge the primary storage capacitor 16 and thereby provide a flash of artificial illumination. A signal corresponding to the flash fire signal applied to the input terminal 22 is also directed along line 48 so as to switch the inverting track hold circuit 36 from its previous tracking mode of operation to a holding mode of operation wherein the output signal value from the inverting track and hold circuit 36 is maintained constant at its last tracked value for the remainder of the flash of artificial illumination. As is now readily apparent, since the photoresponsive element 30 and preamplifier 32 operated to detect only ambient scene light prior to the flash of artificial illumination, the inverting track and hold circuit 36 operates to provide an output signal value during its hold mode of operation which corresponds to the ambient scene light intensity detected immediately prior to the triggering of the flashtube 18 and hence the flash of artificial illumination. The photoresponsive element 30 and operational amplifier 32 continue to operate during the flash of artificial illumination to provide an output signal value to the summing circuit 38 corresponding to the intensity of both the ambient and artificial scene light. The summing circuit 38, in turn, operates to sum the output signal value from the preamp 32 which corresponds to the intensity of the ambient and artificial scene light during the flash of artificial illumination with the inverted value of the output signal from the inverting track and hold circuit 36 which as previously discussed corresponds to the ambient scene light intensity immediately prior to the flash of artificial illumination. Assuming that the ambient scene light intensity remains relatively constant during the short duration of the flash of artificial illumination, there is provided an output artificial scene light detection signal from the summing circuit 38 indicative of only the artificial scene light intensity of the flash regardless of the ambient scene light intensity immediately prior to the flash being fired. Since the ambient scene light intensity can be expected to remain substantially constant for the short duration of the flash, it can be assumed that the output artificial scene light detection signal from the summing circuit 38 in reality corresponds solely to the artificial scene light intensity of the flash regardless of the actual ambient scene light intensity during the flash.

The output artificial scene light detection signal from the summing circuit 38 is thereafter integrated by the integrator 44 until reaching the reference voltage value $V_R$ of the comparator 46 so as to trigger the comparator 46 to provide a flash termination control signal which starts the trigger circuit 26 into operation to trigger the quench tube 24 into conduction so as to rapidly discharge the remaining charge in the primary storage capacitor 16 thereby terminating the flash of artificial illumination in a well-known manner.

Since the flash duration control circuit 28 of this invention provides an output flash termination control signal as a function of the integration of an artificial scene light detection signal indicative of only the artificial scene light intensity of a flash regardless of the ambient light intensity immediately prior to the flash being fired, there may be provided an effective fill flash control such that the flash may be utilized under high ambient scene light intensity conditions to fill in shadows with substantially less risk of over or under exposure resulting from variations in ambient scene light intensity. Thus, an effective control circuit is provided for timing the duration of an electronic flash in order to ensure a substantially uniform flash illumination regardless of whether the flash is utilized in a fill-in flash situation under conditions of relatively high ambient scene light intensity or under ordinary conditions of low ambient scene light intensity where the exposure results primarily from the artificial scene light provided by the flash.

Other embodiments of the invention, including additions, subtractions, deletions and other modifications of the preferred disclosed embodiments of the invention will be obvious to those skilled in the art and are within the scope of the following claims.

What is claimed is:

1. In an electronic flash device of the type having means responsive to the detection of scene light for controlling the duration of the flash of artificial illumination, the improvement comprising means for providing an output flash termination control signal responsive to the integration of an artifical scene light detection signal indicative of only the artificial scene light intensity of the flash regardless of the ambient scene light intensity immediately prior to the flash being fired wherein said artificial scene light detection signal is the sum of a first signal corresponding to the ambient and artificial scene light intensity detected during the flash of artificial illumination and a second signal corresponding to the inverted value of the ambient scene light intensity detected immediately prior to the flash of artificial illumination.

2. The improvement of claim 1 wherein said means for providing said flash termination control signal comprises photoresponsive means for detecting the intensity of scene light and providing an output signal corresponding to the intensity of the scene light so detected; inverting tracking and holding means for providing an output signal corresponding to the inverted value of said output signal from said photoresponsive means, said inverting tracking and holding means also responding to the application of a signal corresponding to the flash fire signal by holding its output signal value constant so as to provide said second signal for the duration of the flash of artificial illumination while said photoresponsive means provides said first signal; and summing means for providing said artificial scene light detection signal responsive to the summation of said first and second signals.

3. The improvement of claim 2 wherein said means for providing said flash termination control signal further comprises integration means for providing an output signal corresponding to the integrated value of said artificial scene light detection signal from said summing means and comparator means for providing said flash termination control signal responsive to the output signal of said integration means reaching a select value.

4. A control circuit for timing the duration of a flash of artificial illumination from an electronic flash comprising:

means for detecting the intensity of both ambient and artificial scene light and providing an output signal corresponding to the intensity of the ambient and artificial scene light so detected; and means responsive to the receipt of a signal corresponding to an applied flash fire signal for converting said output signal from said scene light detecting means to an artificial scene light detection signal indicative of only the artificial scene light intensity of the flash regardless of the ambient scene light intensity immediately prior to the flash being fired and for subsequently integrating said artificial scene light detection signal to provide an output flash termination control signal wherein said converting and integrating means provides said artificial scene light detection signal by summing a first output signal corresponding to the ambient and artificial scene light intensity detected during the flash of artificial illumination and a second output signal corresponding to the inverted value of the output signal from said detecting means for the ambient scene light intensity detected immediately prior to the flash of artificial illumination.

5. The control circuit of claim 4 wherein said converting and integrating means comprises: inverting tracking and holding means for providing an output signal corresponding to the inverted value of said output signal from said detecting means, said inverting tracking and holding means also responding to the application of a signal corresponding to the flash fire signal by holding its output signal value constant so as to provide said second signal for the duration of the flash of artificial illumination while said detecting means provides said first signal; and summing means for providing said artificial scene light detection signal in response to the summation of said first and second signals.

6. The control circuit of claim 5 wherein said converting and integrating means further comprises integration means for providing an output signal corresponding to the integrated value of said artificial scene light detection signal from said summing means and comparator means for providing said flash termination control signal responsive to the output signal of said integration means reaching a select value.

7. An electronic flash device of the type in which the duration of the flash of artificial illumination is controlled comprising:

a flashtube;

means responsive to an applied source of energy for furnishing a DC source of energy;

trigger circuit means responsive to an applied flash fire signal for triggering the discharge of current from said DC source means through said flashtube to produce a flash of artificial illumination;

flash termination means responsive to an applied flash termination control signal for terminating the discharge of current from said DC source means through said flashtube thereby terminating the flash of artificial illumination;

means for detecting the intensity of both ambient and artificial scene light and providing an output signal corresponding to the intensity of the ambient and artificial scene light so detected; and means responsive to the receipt of a signal corresponding to the applied flash fire signal for converting said output signal from said scene light detecting means to an artificial scene light detection signal indicative of only the artificial scene light intensity of the flash regardless of the ambient scene light intensity immediately prior to the flash being fired and for subsequently integrating said artificial scene light detection signal to provide the output flash termination control signal wherein said converting and integrating means provides said artificial scene light detection signal by summing a first output signal corresponding to the ambient and artificial scene light intensity detected during the flash of artificial illumination and a second output signal corresponding to the inverted value of the output signal from said detecting means for the ambient scene light intensity detected immediately prior to the flash of artificial illumination.

8. The electronic flash device of claim 7 wherein said converting and integrating means comprises: inverting tracking and holding means for providing an output signal corresponding to the inverted value of said output signal from said detecting means, said inverting tracking and holding means also responding to the application of a signal corresponding to the flash fire signal by holding its output signal value constant so as to provide said second signal for the duration of the flash of artificial illumination while said detecting means provides said first signal; and summing means for providing said artificial scene light detection signal in response to the summation of said first and second signals.

9. The electronic flash of claim 8 wherein said converting and integrating means further comprises integration means for providing an output signal corresponding to the integrated value of said artificial scene light detection signal from said summing means and comparator means for providing said flash termination control signal responsive to the output signal of said integration means reaching a select value.

* * * * *